United States Patent [19]

Ford et al.

[11] 4,381,029

[45] Apr. 26, 1983

[54] TRAVERSE ROD FOR A VERTICAL BLIND

[75] Inventors: James A. Ford; Steven R. Haarer, both of Sherman Township, St. Joseph County, Mich.

[73] Assignee: Cooper Industries, Inc., Houston, Tex.

[21] Appl. No.: 298,552

[22] Filed: Sep. 2, 1981

[51] Int. Cl.[3] ..... A47H 5/032

[52] U.S. Cl. ..... 160/172

[58] Field of Search ..... 160/126, 172 R, 176 R, 160/345, 346; 16/87.2, 87.4 R, 87.6 R, 87.8, 94 D, 95 D, 96 D

[56] References Cited

U.S. PATENT DOCUMENTS

| | | | |
|---|---|---|---|
| Re. 26,269 | 9/1967 | Ford | 160/346 |
| 3,140,169 | 7/1964 | Arena | 160/178 |
| 3,151,666 | 10/1964 | Ford | 16/87.4 R |
| 3,273,197 | 9/1966 | Ford | 16/94 |
| 3,299,943 | 1/1967 | Poe | 160/176 |
| 3,343,588 | 9/1967 | Cayton | 160/176 |
| 3,503,434 | 3/1970 | Ford | 160/345 |
| 3,693,696 | 9/1972 | Salzmann | 160/345 |
| 3,818,543 | 6/1974 | Baker, Sr. | 16/94 D |
| 3,881,219 | 5/1975 | Haarer | 16/94 |
| 3,951,196 | 4/1976 | Salzmann | 160/345 |
| 3,951,197 | 4/1976 | Cohen et al. | 16/87.6 R |
| 3,996,988 | 12/1976 | de Wit | 160/168 |
| 4,262,728 | 4/1981 | Debs | 160/172 |

*Primary Examiner*—Peter M. Caun

*Attorney, Agent, or Firm*—Flynn, Thiel, Boutell & Tanis

[57] ABSTRACT

The traverse rod assembly includes an elongated hollow traverse rod having a pair of parallel channels each of which has a lengthwise slot therein, one of said slots opening downwardly. Plural hangers are slidably supported in one of the channels and they include structures pivotal about substantially vertical axes. Each hanger also includes additional structure cooperating with an elongated drive rod rotatably supported in pulley housings secured to the ends of the traverse rod. A master carrier is slidably mounted on the traverse rod and is operatively connected to at least one of the hangers to effect movement thereof in response to movement of the master carrier. The hangers are interconnected by a flexible strand which limits the maximum spacing therebetween.

9 Claims, 8 Drawing Figures

TRAVERSE ROD FOR A VERTICAL BLIND

CROSS REFERENCE FOR RELATED APPLICATIONS

This application is related to copending applications filed concurrently herewith, Ser. Nos. 298,554 and 298,553.

FIELD OF THE INVENTION

The present invention relates to a traverse rod and, more particularly, to a type thereof for the support of vertical blind slats which are rotatable about vertical axes between opened and closed positions in association with a window and are additionally laterally movable between positions in front of the window and alongside thereof.

BACKGROUND OF THE INVENTION

The invention disclosed herein arose out of a need to provide an inconspicuous traverse rod assembly for the support of vertical slats of the venetian blind type. Most traverse rods are conspicuously supported across or adjacent the top of a window opening. Usually an attempt is made by the installer to select a color for the rod which will match the decor of the area. However, it has been and still is unlikely that a perfect color matching will be possible. Further, the problem of color matching becomes greater when the decor of the area is changed. Oftentimes, a painter will accidentally smear paint on the traverse rod and fail to remove same thereby causing the rod to be unsightly and often requiring it to be hidden by a valance or other form of drapery, device or material.

The problem of conspicuousness with respect to the structure operable with or by the traverse rod and effecting an operation of the vertical blinds has been solved by the structure disclosed in copending applications filed concurrently herewith, Ser. Nos. 298,554 and 298,553. These arrangements satisfactorily handle the cords for moving the vertical blinds across the window opening and thereby prevent the cords from becoming ensnarled in the drive mechanism for pivoting the vertical blinds about their vertical axes. In addition, the master carrier is readily assembled onto the traverse rod and connected to a selected one of the hangers as well as being easily connected to the cords. However, developing a satisfactorily operable master carrier cooperable with the traverse rod and rod end structures for guiding the cordage which effects movement of a master carrier and hangers supporting the vertical blind slats, has remained a problem.

It has been particularly troublesome to effect a proper securement of the proper hanger to the master carrier in a traverse rod which is of a construction enabling it to be inconspicuous when installed. Accordingly, it is desirous to provide a satisfactorily operable traverse rod which has structure effecting pivotal movement of vertical blind slats about vertical axes without interference from the mechanism for moving the slats laterally.

Other objects of the invention include:

1. Provision of a traverse rod and vertical blind assembly in which the traverse rod has a sufficiently small vertical dimension that it will be inconspicuous when the vertical blinds are open;

2. Provision of a traverse rod and vertical blind assembly, as aforesaid, in which the traverse rod may be placed against a ceiling or recessed into a ceiling without adverse effects upon its operation or upon the appearance of the vertical blinds supported thereby;

3. Provision of a traverse rod and vertical blind assembly cooperating therewith for holding traversable vertical blinds in an attractive condition when closed and for minimizing the pack-back space required for the vertical blinds when same are open;

4. Provision of a traverse rod, as aforesaid, which is attractive;

5. Provision of a traverse rod, as aforesaid, in which the auxiliary parts thereof, such as the master carriers and hangers, are simple and economical to make and nevertheless are effective and reliable in operation; and 6. Provision of a traverse rod, as aforesaid, wherein the master carriers and the hangers are separate components readily connected together upon assembly of the traverse rod and vertical blind assembly.

SUMMARY OF THE INVENTION

The objects and purposes of the invention are met by providing a traverse rod and vertical blind assembly wherein an elongated hollow traverse rod has a pair of parallel channels each of which has a lengthwise slot therein, one of said slots opening downwardly. Plural hangers which are slidably supported in one of the channels, include structures pivotal about substantially vertical axes. Each of the hangers also includes additional structure cooperating with an elongated drive rod rotatably supported in pulley housings secured to the ends of the traverse rod. A master carrier is slidably mounted on the traverse rod and is operatively connected to at least one of the hangers to effect movement thereof in response to movement of the master carrier. Each of the hangers is interconnected by a flexible strand which limits the maximum spacing therebetween. Thus, and in this particular arrangement, the structure for effecting movement of the slats about a vertical axis is housed in a channel separate from the channel housing the cords which effect a movement of the master carriers with respect to the traverse rod.

BRIEF DESCRIPTION OF THE DRAWINGS

Further objects and purposes of this invention will be apparent to persons acquainted with apparatus of this type upon reading the following specification and inspecting the accompanying drawings, in which.

DETAILED DESCRIPTION

Figure 5:
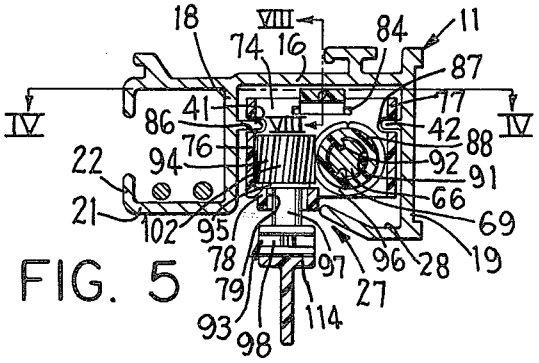
FIG. 5 is a sectional view taken along the line V—V of FIG. 4.

The words "front," "rear," "up," "down," "right" and "left" will designate directions in the drawings to which such reference is made, the "front" side of the master carrier and traverse rod in FIG. 5 being the right side thereof. The words "in" and "out" will refer to directions toward and away from the geometric center of the device and designated parts thereof. Such terminology will include the words above specifically mentioned, derivatives thereof and words of similar import.

Figure 1:
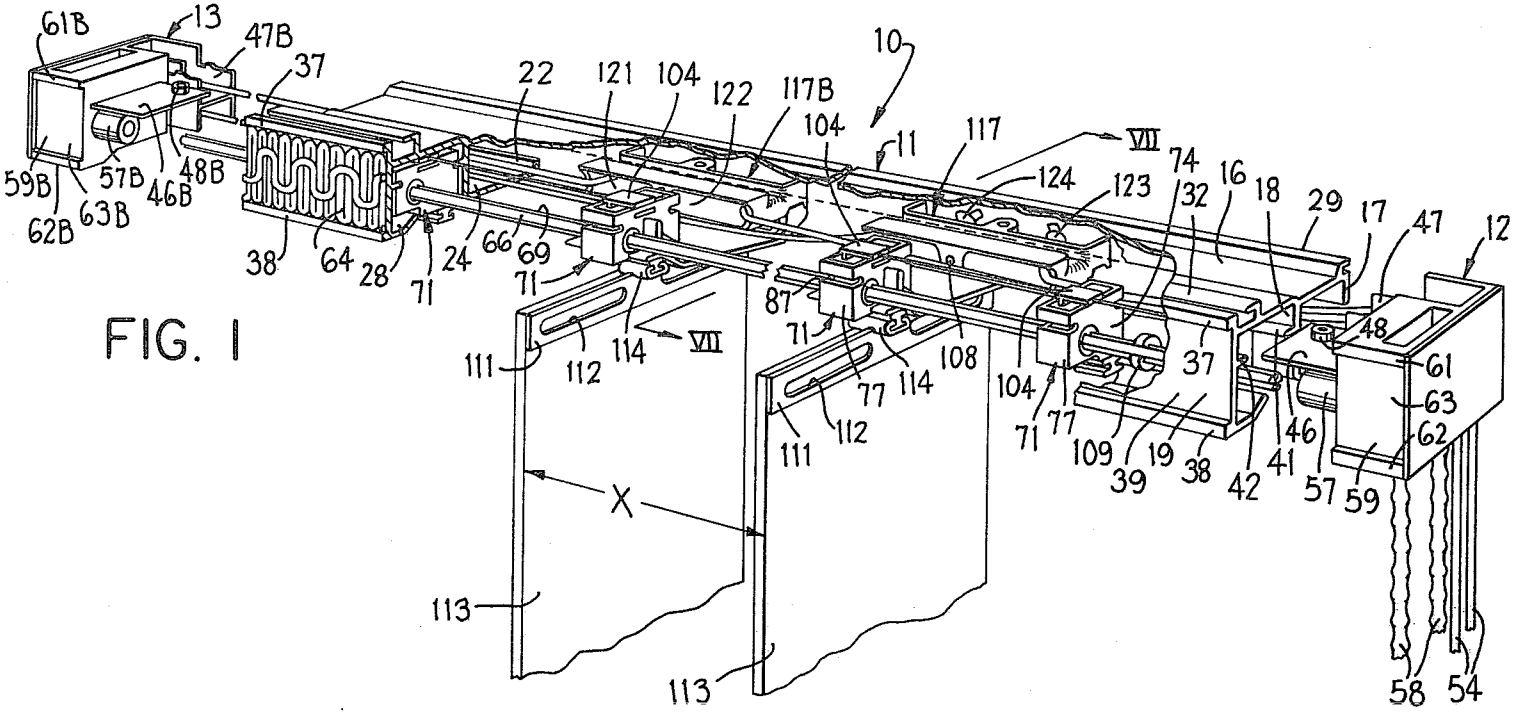
FIG. 1 is an exploded, broken and perspective view, partially sectioned, of the front of a traverse rod embodying the invention.
Figure 2:
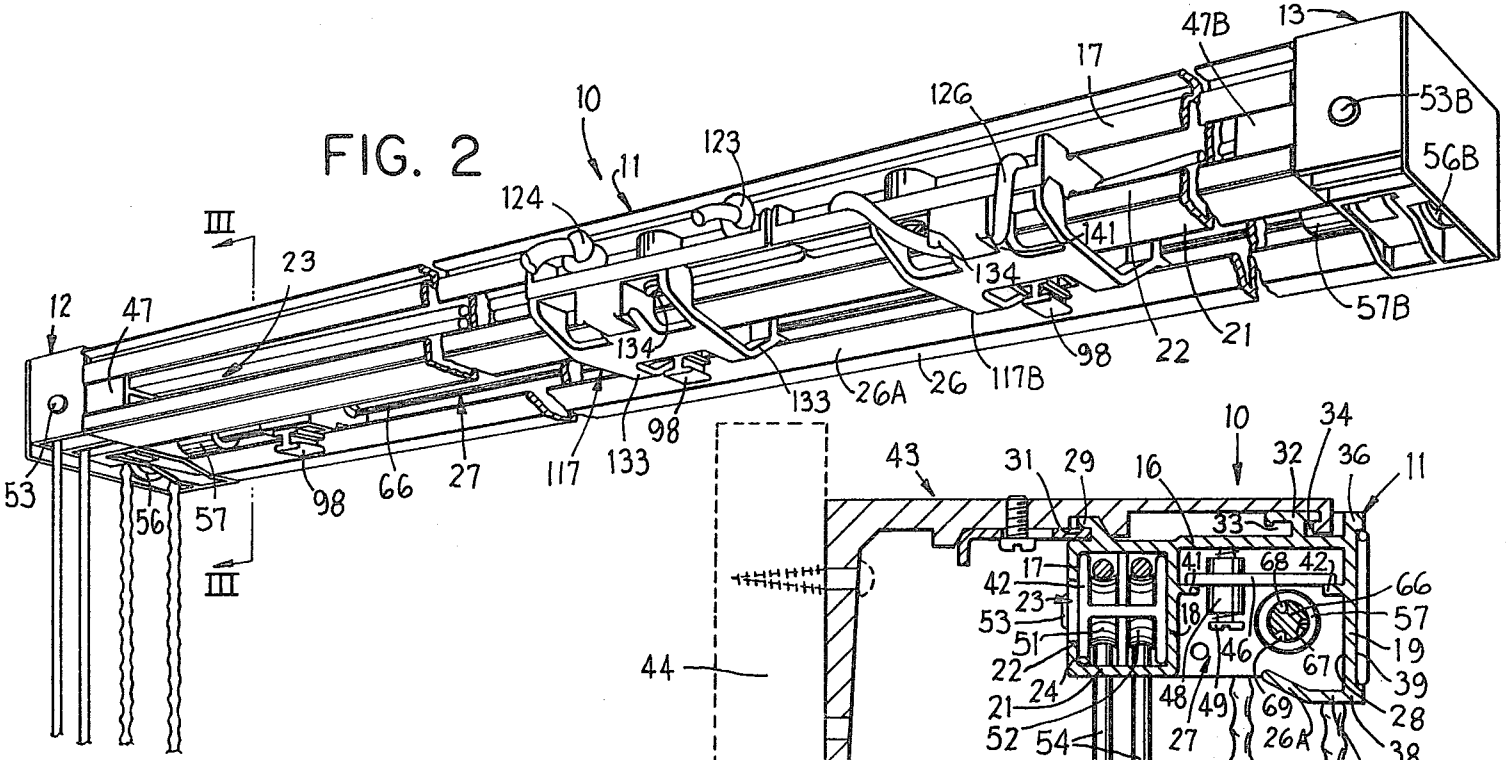
FIG. 2 is a perspective view of the rear of the traverse rod.

A preferred embodiment of the traverse rod assembly which is illustrated at 10 in FIGS. 1 and 2, includes an elongated traverse rod 11 and a pair of end structures 12 and 13 on opposite ends thereof. The specific features of the end structures 12 and 13 and the cooperation of the master carrier and sliders with each other and with other parts on the traverse rod are the subject matter of the aforementioned two copending applications filed concurrently herewith. The first such copending application is entitled END STRUCTURE FOR A TRAVERSE ROD, Ser. No. 298,554 and the second application is entitled MASTER CARRIER FOR A TRAVERSE ROD, Ser. No. 298,553. These two applications are incorporated by reference herein.

The traverse rod 11 has a top wall 16 and downwardly extending and traversely spaced rear wall 17, middle wall 18 and front wall 19. A substantially horizontal bottom wall 21 is integral with the middle wall 18 at the bottom thereof and terminates in an upwardly extending wall 22 coplanar with the rear wall 17. The upper edge of the rear wall 22 and the lower edge of the rear wall 17 are spaced vertically from one another to define an opening or slot 23 into a channel 24 defined by the top wall 16 and the walls 17, 18, 21, and 22. A substantially horizontally extending flange 26 is integrally connected to the front wall 19 at the bottom edge thereof and extends rearwardly toward but terminates short of the middle wall 18. The flange 26 has an upwardly inclined segment 26A to define an opening or slot 27 into a channel 28 defined by the flange 26, the front wall 19, the top wall 16 and the middle wall 18.

The top wall 16 has plural upstanding and lengthwise ribs thereon. The rib 29 extends upwardly adjacent the plane containing the walls 17 and 22 and has a rearwardly opening recess 31 therein. The rib 32 extends upwardly from the top wall intermediate the plane containing the middle wall 18 and the front wall 19 and has a rearwardly opening recess 33 and a further frontwardly opening recess 34 opening in the opposite direction. The rib 36 extends upwardly in generally the same plane as the front wall 19 and has a bead 37 extending forwardly of the plane containing the front wall 19. Similarly, a small bead 38 extends forwardly of the front wall 19 but in the plane of the bottom wall 26. The beads 37 and 38 define a shallow trough 39, the purpose of which will be explained below.

A pair of inwardly projecting and coplanar flanges 41 and 42 are provided in the channel 28 approximately one-third of the way down from the top wall 16.

A conventional type of wall mounted bracket 43 can be used to effect a securement of the traverse rod 11 to an upstanding wall 44. Alternatively, a related bracket (not illustrated) can be utilized for effecting a securement of the traverse rod to the ceiling. Both types of brackets are generally illustrated in U.S. Pat. No. 3,273,197 and reference thereto is incorporated herein.

Preferably, the end structures 12 and 13 (FIGS. 1, 2 and 4) are mirror images of each other. The end structure 12, for example has a pair of guide members 46 and 47 (FIGS. 3 and 4) which are received in the channels 28 and 24, respectively. The guide member 46 has a cylindrical embossment 48 thereon, the axis of which extends through the opening 27 into the channel 28. A screw fastener 49 is received into a coaxial opening through the cylindrical embossment 48. In this particular embodiment, the guide member 46 is flat and rests on the coplanar and laterally spaced flanges 41 and 42. Thus, when the end of the screw fastener 49 remote from the head thereof engages the top wall 16 of the traverse rod 11, the guide member 46 will be urged downwardly into a tight, frictional engagement with the flanges 41 and 42 to secure the end structure 12 to the end of the traverse rod 11.

The end structure 12 also has a pair of pulleys 51 and 52 (FIG. 3) which are mounted on the guide member 47 and are rotatable about the horizontal axis of an axle 53. The axle 53 extends perpendicular to the lengthwise extent of the traverse rod. The pulleys 51 and 52 guide cordage 54 and radii thereof are aligned with the channel 24 in the traverse rod 11.

Figure 3:
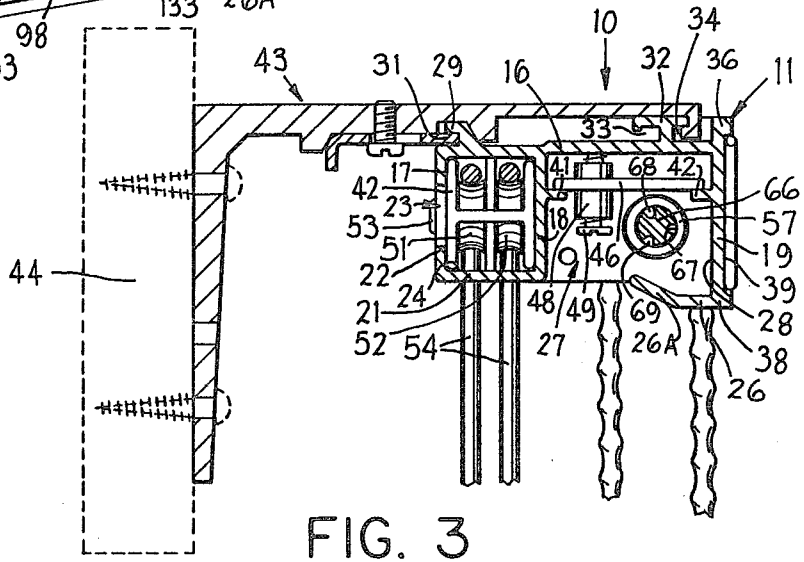
FIG. 3 is a sectional view taken along the line III—III of FIG. 2 and showing a mounting bracket.

A further pulley 56 (FIGS. 2 and 4) is secured to an axle 57 rotatably supported on the end structure 12. The axis of the axle 57 extends lengthwise of the traverse rod 11 and within the channel 28 as shown in FIG. 3. The pulley 56 has a plurality of arcuately spaced pockets (not shown) adapted to receive the beads of a beaded cord 58 which, when pulled, rotates the pulley 56, hence the axle 57. The width and height of the end structure 12 are equal to the width and height of the traverse rod 11.

The front wall 59 of the end structure 12 is coplanar with the frontwardly facing surface of the front wall 19 on the traverse rod 11. In addition, beads 61 and 62 are provided at the upper and lower edges, respectively, of the front wall 59 and are colinear with the beads 37 and 38, respectively, on the traverse rod 11. Thus, the trough 63 formed between the beads 61 and 62 forms a continuation of the trough 39 on the traverse rod 11. In the assembled condition, fabric 64 is placed in the troughs 39 and 63 to assist in concealing the traverse rod when in the installed position. It is preferable from the standpoint of appearance that the thickness of the fabric 64 be equal to the depth of the troughs 39 and 63.

The end structure 13 (FIGS. 1 and 2), being a mirror image of the end structure 12, is not described in detail. However, the parts of end structure 13 identified by numerals having the suffix B correspond exactly to the parts on end structure 12 identified by the same numerals without the suffix B.

An elongated drive rod 66 (FIG. 3) has at least one, preferably plural and circumferentially spaced, grooves 69 extending the full length thereof. Said rod 66 is disposed in the channel 28 of the traverse rod 11 and is drivingly connected to and between the axles 57 and 57B in the end structures 12 and 13. In this particular embodiment, the axle 57 has an axially extending central opening 67 in which is received one end of the drive rod 66. Further, a key 68 on the axle 57 extends radially inwardly into the opening 67 where it is received into a selected one of the grooves 69 to drivingly couple the drive rod 66 to the axle 57 and, in a similar manner, to the axle 57B.

Plural hangers 71 are slidably disposed in the channel 28. More particularly, each hanger 71 has a rectangularated one of the hangers 71 between positions in front of a window opening and positions alongside thereof.

OPERATION

Although the operation of the traverse rod assembly embodying the invention has been indicated somewhat above, said operation will be further described hereinbelow for convenience.

Figure 4:
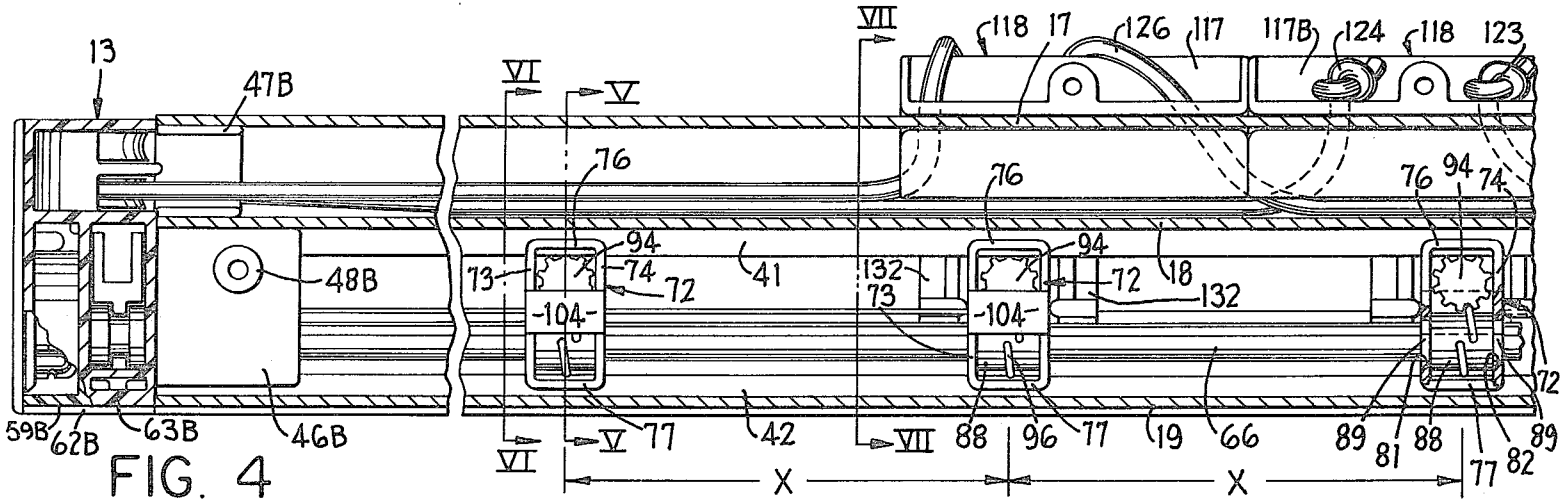
FIG. 4 is a sectional view taken along the line IV—IV of FIG. 5.

The cordage 54 effects a movement of the two master carriers 117 and 117B between positions in front of a window opening and positions alongside thereof. FIGS. 1, 2 and 4 show the master carriers positioned in front of the window opening. This will also position the centralmost ones of the hangers 71 at a fixed spacing X from one another as illustrated in FIG. 4. This will cause, due to the fastening arrangement 103, a positioning of the remainder of the hangers 71 at the spacing X from one another. That is, the strand 108 extending between the fasteners 104 is of a length to position the fasteners at the aforesaid X spacing from one another. The hanger closest to the end structures 12 and 13 will be prevented from following the movement of the remainder of the hangers toward the central portion of the traverse rod 11 by the provision of the aforesaid clip 109.

Positioning of the master carriers 117 and 117B as illustrated in FIGS. 1, 2 and 4 will now space the material 113 constituting the vertical slats or blinds at evenly spaced intervals across the width of the window opening. In the position illustrated in FIG. 1, the material is located in planes which are perpendicular to the plane of the window opening. A pulling of the beaded strand 58 in one direction will effect a rotation of the axles 57 and drive rod 66 coupled therewith. Due to a coupling of the drive rod 66 to the worm gear 88, the worm gear 88 will also be rotated to cause a rotation of the pinion gear 94 on the support member 93 about a vertical axis. This rotary movement will effect a rotary movement of the material 113 of each of the vertical blinds to effect an orientation thereof into a plane which is generally parallel to the plane of the window opening thereby blocking the passage of light. A reverse movement of the beaded strand 58 will return the vertical blinds to the original position thereof illustrated in FIG. 1.

In a preferred embodiment, the material 113 of each of the vertical blinds is selected to match the fabric 64 in the troughs 39, 63 and 63B on the front face of the traverse rod and end structures 12, 13. Thus, when the vertical blind arrangement is in the closed position, that is, the material is oriented in a plane generally parallel to the plane of the window opening, the material of the vertical blind will have the appearance of a single piece of material across the entire height of the window. This arrangement will also further contribute to making the traverse rod inconspicuous.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A traverse rod assembly for a blind having plural vertically extending slats, comprising:

a horizontally elongated hollow traverse rod having front, top, bottom and rear walls, said traverse rod having an intermediate wall depending from said top wall between and substantially parallel to said front and rear walls for dividing the interior of said traverse rod into front and rear elongated channels, said bottom wall having a first lengthwise slot formed therein and opening upwardly in direct communication with said front channel, said rod also having a second lengthwise slot formed therein and opening inwardly in direct communication with said rear channel;

elongated rotatable shaft means positioned within and extending lengthwise through said front channel, said shaft means being disposed with its axis substantially parallel to the lengthwise direction of said front channel;

a plurality of hanger means individually and independently slidably supported in said front channel and extending downwardly through said first slot, each said hanger means including a housing means which is slidably supported within said first channel and is slidable along said rotatable shaft means, said hanger means also including first means pivotally supported on said housing means for pivotal movement about a substantially vertical axis and projecting downwardly therefrom through said first slot and having second means adjacent the lower end thereof for engaging the top of one of said slats, said hanger means further including third means rotatably supported on said housing means and rotatably drivingly connecting said first means to said shaft means for effecting rotation of said first means in response to rotation of said shaft means;

elongated and flexible means positioned within said front channel and connected between adjacent hanger means for limiting the maximum spacing between adjacent said hanger means;

master carrier means slidably supported on said rod and operatively connected with one of said hanger means for effecting movement thereof along said front channel in response to slidable displacement of said master carrier means;

said master carrier means having a first carrier part slidably disposed in said front channel and operatively cooperating with said one hanger means, said master carrier means also having a second part slidably disposed in said rear channel and a third part connected to said first part and projecting rearwardly for connection to said second part; and elongated flexible propelling means housed within and extending in a lengthwise direction of said rear channel, said propelling means being operatively connected to said master carrier means for controlling the slidable movement thereof along said rod.

Figure 8:
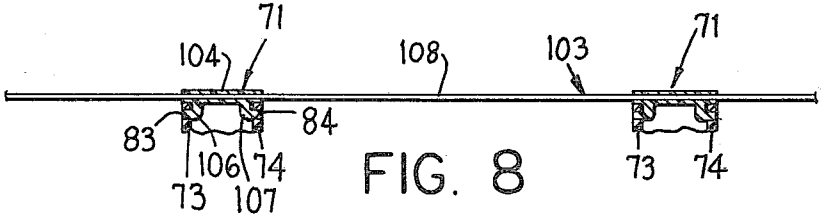
FIG. 8 is a sectional view taken along the line VIII—VIII of FIG. 5.

2. A traverse rod assembly according to claim 1, wherein the bottom wall of said rod includes a front bottom wall portion which projects rearwardly from the front wall and terminates at one edge of said first slot, said bottom wall including a rear bottom wall portion which extends rearwardly from the other edge of said first slot and terminates adjacent said rear wall, said rear bottom wall portion being spaced upwardly above the plane of said front bottom wall portion, said second slot opening rearwardly through said rear wall, and said third part of said carrier means being generally of an upwardly opening channel-like configuration and including a front leg which projects upwardly through said first slot into said front channel and a rear leg which projects upwardly behind said rear wall in the shaped housing 72 (FIG. 4) with upright side walls 73 and 74 and interconnecting upright end walls 76 and 77. The lower edges of the side walls 73 and 74 and the end wall 76 are joined by a bottom wall 78 which extends only part way between the end walls 76 and 77. A rectangular-shaped opening 79 (FIG. 5) is provided in the bottom wall 78. A pair of axially aligned circular openings 81 and 82 are provided in the side walls 73 and 74, respectively. A pair of rectangular openings 83 and 84 (FIG. 8) are provided in the side walls 73 and 74 immediately above the openings 81 and 82, respectively. It is preferred that the openings 83 and 84 be centrally disposed between the end walls 76 and 77. The end walls 76 and 77 have elongated grooves or cutouts 86 and 87, respectively, which extend across the full width thereof. The grooves 86 and 87 are adapted to receive the flanges 41 and 42 in the channel 28 of the traverse rod 11 as illustrated in FIG. 5 to thereby slidably support the hangers for lengthwise movement within the channel 28.

A worm gear 88 (FIGS. 4 and 5) is rotatably supported in the circular openings 81 and 82, as shown on the right end of FIG. 4. More specifically, the worm gear 88 has a pair of axle segments 89 of reduced diameter on opposite ends thereof which are rotatably received in the circular openings 81 and 82. This construction prevents relative axial movement of the worm gear 88 relative to the housing 72. The interior of the worm gear 88 is hollow to define an opening 91 therethrough.

A key 92 (FIG. 5) is molded to the interior wall of the opening 91 and projects radially inwardly. The key is received in the axially extending groove 69 in the drive rod 66. A slat support member 93 (FIG. 5) is received in the housing 72 between the peripheral surface of the worm gear 88 and the end wall 76. The support member 93 has a pinion gear 94 thereon engaged with and driven by the helical thread 96 on the worm gear 88. The lower surface 95 of the pinion gear 94 rests on the upper surface of the bottom wall 78.

Figure 6:
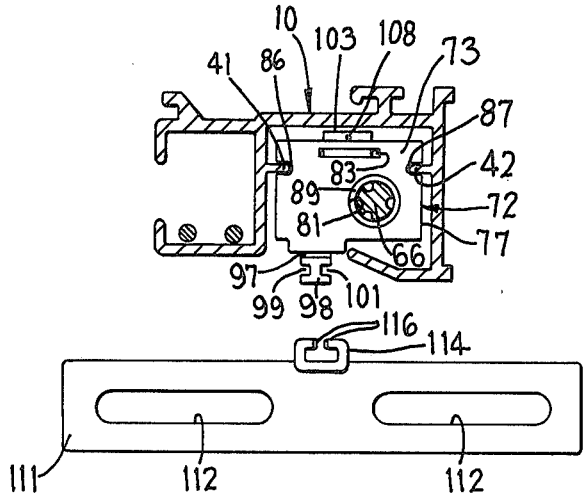
FIG. 6 is a sectional view taken along the line VI—VI of FIG. 4.

A cylindrical shaft segment 97 (FIG. 5) extends through the rectangular-shaped opening 79 in the bottom wall 78. The lower end of the shaft segment 97 has a generally I-shaped member 98, an end view thereof being illustrated in FIG. 6. The I-shaped member is slightly smaller in rectangular shape than the size of the opening 79 and has a pair of laterally facing channels 99 and 101 as also shown in FIG. 6.

In this particular embodiment, the teeth 102 on the pinion gear 94 are contained in planes which are inclined to the vertical at generally the same helix angle for the helical tooth 96 on the worm gear 88. This construction will facilitate the nonbinding reception of the tooth 96 into the spacing between mutually adjacent teeth on the pinion gear 94.

Selected ones of the hangers 71 are connected together by a fastening arrangement 103 (FIG. 8) which is composed of a fastener 104 having a pair of yieldable L-shaped legs 106 and 107 thereon. The horizontal leg segments of the legs 106 and 107 are received into the openings 83 and 84 in the housing 72. An elongated flexible strand or cord 108 is secured to each fastener 104 by any convenient means not illustrated.

A C-shaped clip 109 (FIG. 1) is tightly gripped onto the rod 66 preferably between the two endmost hangers 71 at the opposite ends of the traverse rod 11. The C-shaped clip 109 can be slid axially of the drive rod 66 to limit the amount of axial movement of the endmost hanger toward the center of the traverse rod 11.

A slat or blind bracket 111 has a generally rectangular shape (FIG. 6) and is of a uniform thickness throughout its width. It has a pair of openings 112 therein to facilitate securement of the blind material 113 (FIG. 1) thereto. A C-shaped connector 114 is centrally disposed on the blind bracket 111 and has a pair of legs 116, the free ends of which are received in the channels 99 and 101 of the I-shaped member 98 on the support member 93. Thus, rotation of the support member 93 about its vertical axis will cause a corresponding rotation of the blind bracket 111 therewith.

The foregoing discussion has assumed that there has been provided a sufficiently long traverse rod 11 such that a pair of master carriers 117 and 117B are provided thereon. However, it is to be recognized that when the traverse rod is sufficiently short, only one such master carrier need be provided to effect a movement of all of the hangers to one side or the other of the window opening. For purposes of the following discussion, it will be assumed that the traverse rod is sufficiently long to justify the provision of a pair of master carriers 117 and 117B thereon. The master carriers 117 and 117B are composed of identical parts, namely, a master carrier slide 118 and a master carrier bridge 119. The master carrier slide 118 is slidably disposed partially within the chamber 24 with the rearward portion thereof projecting through the opening 23.

The master carrier slide 118 has a pair of openings 121 and 122 (FIG. 1) therethrough to provide communication from within the channel 24 to a location externally of the traverse rod 11 through the aforesaid openings. Thus, the cords 54 can be laced through the aforesaid openings 121 and 122, as shown in FIGS. 1 and 4. The ends of the cords 54 are provided with knots 123 and 124 to prevent retraction of the cords back through the openings. In the master carrier slide 118 (FIG. 4) of the carrier 117, a particular reach 126 of the cords 54 is simply laced through the openings and is generally a continuous member from the knot 124 through to the pulleys in the end structure 13.

Figure 7:
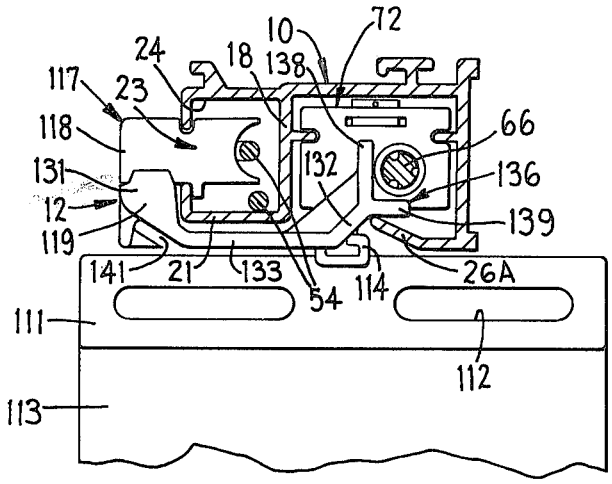
FIG. 7 is a sectional view taken along the line VII—VII of FIG. 4.
Figures 2, 3:
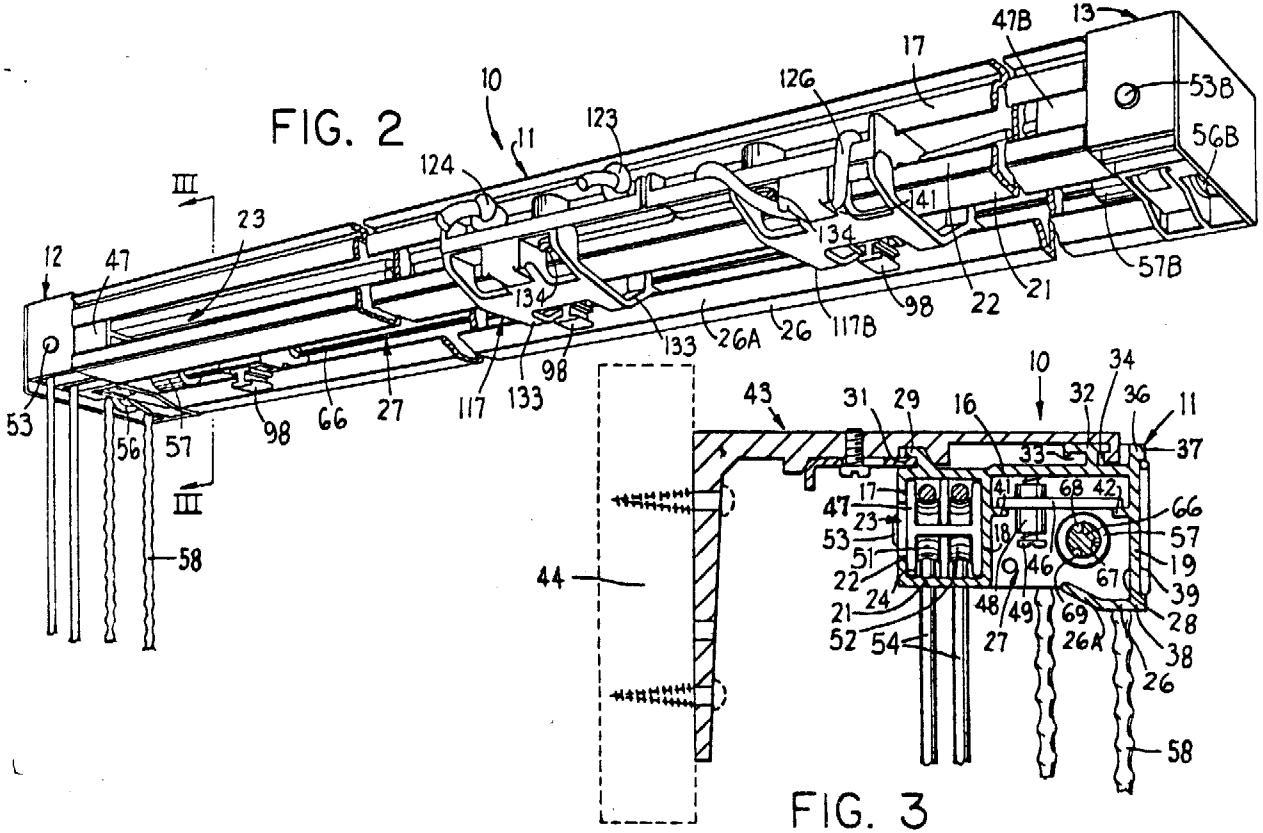

The master carrier bridge 119 is somewhat U-shaped (FIG. 7) having a pair of upstanding legs 131 and 132 and an interconnecting bight 133. The upper end of the leg 131 is fixedly connected to the master carrier slide 118 as by a screw 134 (FIG. 2). The upstanding leg 132 is actually two horizontally spaced leg portions having L-shaped supports 136 thereon. The upstanding leg 138 of each of these L-shaped supports projects between the drive rod 66 and the intermediate wall 18 of the traverse rod 11. The horizontally extending leg 139 slidably rests on the edge of the wall segment 26A of the traverse rod 11. The bight 133 extends below the wall 21 of the channel 24. Each master carrier bridge 119 has a downwardly opening slot 141 therein in the lower part of the leg 131. The cordage 54 is generally compressible and the diameter thereof is slightly greater than the width of the slot 141. Thus, the cordage must be slightly compressed in order for it to be inserted into the slot 141 to effect a securement thereof to the master carrier bridge, this being illustrated by the intermediate cord reach 126 associated with master carrier 117B in FIG. 2. The horizontal spacing between the leg portions of leg 133 is such as to snugly embrace a hanger 71 therebetween as shown in FIG. 4. Thus, a movement of the master carriers 117 and 117B will effect a movement of the associvicinity of said second slot, said third part also including a flat, thin, horizontally extending, platelike bight which extends between and fixedly interconnects said front and rear legs, said bight being positioned below but closely adjacent said rear bottom wall portion.

3. A traverse rod assembly according to claim 2, wherein said master carrier means includes a first one-piece carrier member which defines said first and third parts, said master carrier means also including a second one-piece carrier member which defines said second part, said second carrier member being slidably supported in said rear channel and having a portion thereof which projects rearwardly through said second slot, and releasable fastening means for releasably but fixedly connecting the rear portion of said first carrier member to the rearwardly projecting portion of said second carrier member.

4. A traverse rod assembly according to claim 3, wherein said second carrier member has a length in the lengthwise direction of said rod which substantially exceeds the length of said first carrier member, and said releasable fastening means permitting said first carrier member to be fixedly but releasably attached to said second carrier member at a location disposed adjacent one end of said second carrier member.

5. A traverse rod assembly according to claim 4, wherein a pair of said master carrier means are slidably mounted on said traverse rod, each said master carrier means having its first carrier member mounted on the end of its respective second carrier member which is remote from the other master carrier means, the other ends of said second carrier members being disposed in opposed and abutting engagement with one another when said master carrier means are located adjacent one another to effectively space the hanger means as associated with said pair of master carrier means the same distance apart as the maximum spacing between said hanger means as permitted by said elongated and flexible means.

6. A traverse rod assembly according to claim 5, wherein said first part of said master carrier means is bifurcated and includes two portions which are spaced apart in the lengthwise direction of said front channel and are separated by a recess which opens downwardly through said first slot, said one hanger means being slidably and independently supported in said front channel but positioned within said recess so as to be closely confined between the two spaced portions of said master carrier means for effecting slidable displacement of said one hanger means in response to a corresponding slidable displacement of said master carrier means, said one hanger means being solely abuttingly engaged with said master carrier means due to its being confined within said recess.

7. A traverse rod assembly according to claim 2, wherein said first part of said master carrier means is bifurcated and includes two portions which are spaced apart in the lengthwise direction of said front channel and are separated by a recess which opens downwardly through said first slot, said one hanger means being slidably and independently supported in said front channel but positioned within said recess so as to be closely confined between the two spaced portions of said master carrier means for effecting slidable displacement of said one hanger means in response to a corresponding slidable displacement of said master carrier means, said one hanger means being solely abuttingly engaged with said master carrier means due to its being confined within said recess.

8. A traverse rod assembly according to claim 1, wherein said first part of said master carrier means is bifurcated and includes two portions which are spaced apart in the lengthwise direction of said front channel and are separated by a recess which opens downwardly through said first slot, said one hanger means being slidably and independently supported in said front channel but positioned within said recess so as to be closely confined between the two spaced portions of said master carrier means for effecting slidable displacement of said one hanger means in response to a corresponding slidable displacement of said master carrier means, said one hanger means being solely abuttingly engaged with said master carrier means due to its being confined within said recess.

9. A traverse rod assembly according to claim 1, wherein said first part of said master carrier means is of an L-shaped configuration when viewed in the lengthwise direction of said front channel and includes a lower substantially horizontal leg portion which is positioned above and slidably supported on said bottom wall directly beneath said shaft means, said first part including a side leg which is fixed to and projects substantially perpendicularly upwardly from said bottom leg and is positioned closely adjacent said shaft means.

* * * * *

UNITED STATES PATENT AND TRADEMARK OFFICE

CERTIFICATE OF CORRECTION

PATENT NO. : 4,381,029

DATED : April 26, 1983

INVENTOR(S) : James A. Ford et al.

It is certified that error appears in the above-identified patent and that said Letters Patent is hereby corrected as shown below:

The sheet of drawing consisting of Figs. 2 and 3 should be deleted and the attached sheet substituted therefor.

Column 4, line 25, "(Figs. 2 and 4)" should read -- (Fig. 2) --.

Column 4, line 68, "particularly" should read -- specifically --.

Signed and Sealed this

*Twenty-fifth* Day of *October 1983*

[SEAL]

*Attest:*

GERALD J. MOSSINGHOFF

*Attesting Officer*

*Commissioner of Patents and Trademarks*